United States Patent [19]

Else

[11] Patent Number: 5,054,671

[45] Date of Patent: Oct. 8, 1991

[54] QUICK-DRAW HANDGUN HOLSTER

[75] Inventor: Robert L. Else, Umatilla, Oreg.

[73] Assignee: David D. Farley, Portland, Oreg.

[21] Appl. No.: 484,270

[22] Filed: Feb. 26, 1990

[51] Int. Cl.[5] ..... F41C 33/00; A45C 1/04

[52] U.S. Cl. ..... 224/192; 224/193; 224/196; 224/229; 224/911

[58] Field of Search ..... 224/192, 193, 198, 229, 224/238, 243, 253, 911, 912, 196

[56] References Cited

U.S. PATENT DOCUMENTS

| | | | |
|---|---|---|---|
| 769,428 | 9/1904 | Brannon | 224/911 |
| 1,322,198 | 11/1919 | Morrison | 224/193 |
| 1,547,800 | 7/1925 | Franz | 224/243 |
| 2,001,321 | 5/1935 | Berns | 224/911 |
| 2,410,640 | 11/1946 | Engle | 224/198 |
| 2,893,615 | 7/1959 | Couper | 224/912 |
| 3,227,336 | 1/1966 | Dickey | 224/192 |
| 3,250,448 | 5/1966 | Clark | 224/252 |
| 3,300,109 | 1/1967 | Clark | 224/252 |
| 3,379,349 | 4/1968 | Hier | 224/252 |
| 3,550,821 | 12/1970 | Daigle | 224/255 |
| 3,565,303 | 2/1971 | Kippen | 224/253 |
| 3,731,858 | 5/1973 | Baker | 224/911 |
| 3,910,469 | 10/1975 | Baldocchi | 224/198 |
| 4,165,826 | 8/1979 | Chica | 224/191 |
| 4,218,000 | 8/1980 | Mixson | 224/193 |
| 4,235,356 | 11/1980 | Atchisson | 224/192 |
| 4,253,592 | 3/1981 | Anderson | 224/198 |
| 4,741,465 | 5/1988 | Johnson | 224/230 |

*Primary Examiner*—Henry J. Recla
*Assistant Examiner*—Keith Kupferschmid
*Attorney, Agent, or Firm*—Eugene D. Farley

[57] ABSTRACT

A quick-draw handgun holster is contoured and designed to be worn beneath clothing in the abdominal area with the gun lying obliquely with its butt only extending angularly upwardly for engagement by a lateral, substantially horizontal movement of the hand of the wearer.

8 Claims, 1 Drawing Sheet

QUICK-DRAW HANDGUN HOLSTER

This invention relates to quick draw handgun holsters of the class designed to be worn concealed within the waistband in the abdominal area of the wearer.

BACKGROUND AND GENERAL STATEMENT OF THE INVENTION

It is the general purpose of the present invention to provide a quick draw handgun holster characterized by the following features and advantages:

In its use position the holster and the handgun which it contains are completely concealed and unobvious to an observer.

It makes possible withdrawal of the gun from the holster with remarkable celerity—in a fraction of a second.

It enables withdrawal of the gun in a precise and sure manner, without making false (and possibly fatal) moves.

In the starting position of gun withdrawal the hand is in a normal position at the side, or in front, rather than in the stilted position usually assumed by the gunman who wears a conventional holster at his side or back. The gun is worn in a position such that it is close to the hand when the hand is in its normal position.

The holster, and the gun which it contains, adapt to the contour of the body so that they may be worn comfortably.

Because of the position of the gun on the body, no part of it projects away from the body no matter how the wearer may bend or twist. Because of this the holster effectively hides the gun when worn under very light clothing.

With the holster worn on the selected side, the gun may be withdrawn using either the right or left hand from either a standing or a sitting position.

Since the hand normally is positioned only a few inches from the gun butt, the gun may be withdrawn quickly and with an unobvious motion.

Broadly considered, the holster which achieves the foregoing and other objects of the invention belongs to the class adapted to be worn concealed inside the waistband, i.e. between the waistband of a garment and the waist of the wearer, in the abdominal area. It comprises front and back panels joined to form a pouch. The pouch top is open and wide-mouthed to receive the gun. The bottom is substantially closed to provide an inner bearing area against which the muzzle of the gun bears and pivots during its sheathing in, and withdrawal from, the holster.

The inner side margin of the pouch is open along its upper length to permit pivoting of the gun. The outer side margin is substantially closed to provide an inner bearing area against which the top of the gun rests when it is in its sheathed position within the holster.

The inner and outer side margins are disposed at an angle such that when the holster is mounted within the waistband, its outer side margin lies substantially parallel to and adjacent the groin area of the wearer.

The length of the holster is such that when the gun is sheathed obliquely within the holster with its muzzle bearing against the holster bottom and its barrel bearing against the holster outer side margin, its handle will project angularly upwardly above the holster top to a predetermined position in which it is readily available for engagement by the hand of the wearer.

THE DRAWINGS

DESCRIPTION OF A PREFERRED EMBODIMENT OF THE INVENTION

Figure 1:
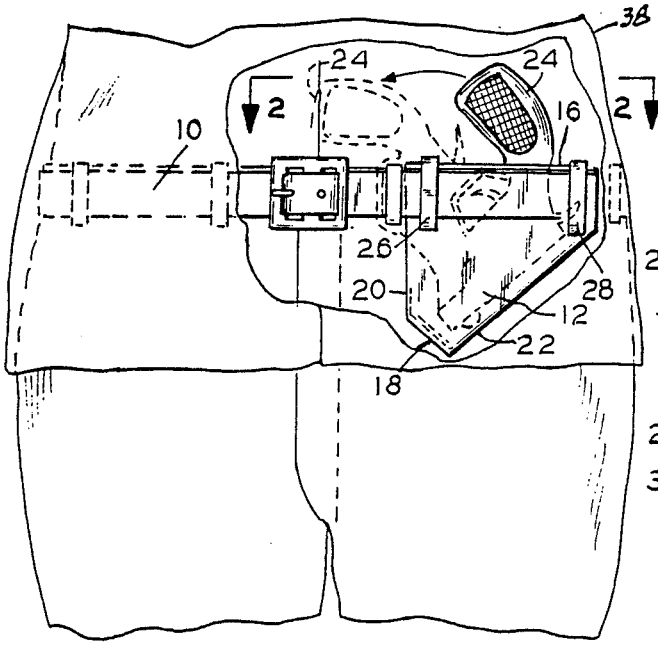
FIG. 1 is a view in front elevation of the holster in its use position, mounted on the belt of the user.

As illustrated in FIG. 1, the holster of my invention is adapted to be worn concealed beneath the clothing in the groin area. It accordingly is adapted to be inserted inside the waistband or belt 10, i.e. between the waistband of a garment and the waist of the wearer, on either the right or left side. In the illustration, it is shown mounted on the left side.

Figure 2:
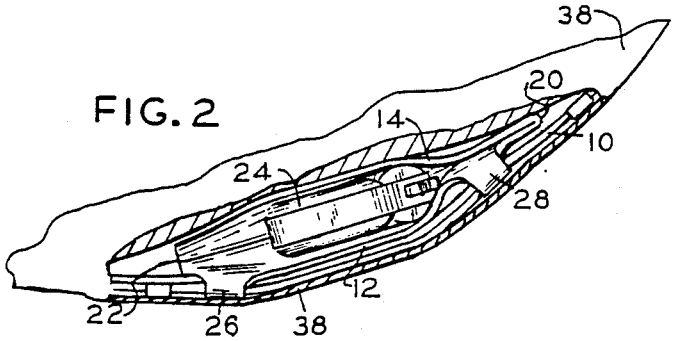
FIG. 2 is a fragmentary top perspective view of the holster in its use position, looking in the direction of the arrows of line 2—2 of FIG. 1.

The holster comprises a front panel 12 and a back panel 14 joined to form a pouch, FIG. 2. The pouch is contoured and dimensioned to provide a wide-mouthed top 16, a bottom 18, an inner side margin 20 and an outer side margin 22.

Top 16 is contoured to form an elongated mouth, FIG. 2, which receives the gun. In its use position, top 16 lies substantially parallel to the upper edge of belt 10 behind which it is concealed. Its inner end lies proximate the navel of the wearer and its outer end lies proximate the hip of the wearer.

Bottom or foot 18 is substantially closed to provide an inner bearing area against which the muzzle of the gun bears and pivots during its sheathing in, and withdrawal from, the holster. This is apparent also from a consideration of FIG. 1.

Inner side edge 20 lies at substantially right angles to the waistband and to top 16. Its upper portion is open to permit sideways withdrawal of the gun. Its lower portion may be closed a distance equal to substantially 1/5th to 2/5ths the length of the side edge.

Outer side margin or spine 22 is elongated and substantially closed along its entire length to provide an obliquely disposed inner bearing area against which the top of the gun, i.e. the upper, aiming side rests when it is sheathed within the holster (FIG. 1). The sheathed weapon thus lies within the holster in an oblique position, disposed neither vertically nor horizontally. In this respect it differs significantly from conventional holsters in which the gun is disposed vertically. The oblique disposition of the gun in turn causes gun butt 24 to extend angularly upwardly when the gun is sheathed. In the normal or conventional holster the gun butt is disposed horizontally.

Figure 4:
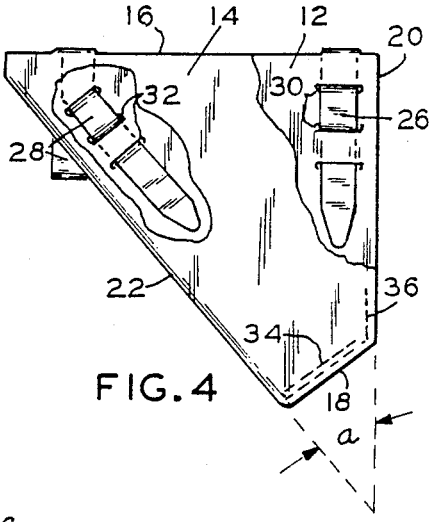
FIG. 4 is a view in rear elevation of the holster.

Although the angle ("a" FIG. 4) at which outer margin 22 lies with reference to inner margin 20 is somewhat variable, in general, to achieve the purposes of the invention, the two margins will lie at an angle to each other which is within the broad range of from about 30 to about 60 degrees, preferably from about 35 to about 55 degrees.

When the angle is 45 degrees, the holster will define a substantially right triangular shaped pocket for receiving the gun. The top 16 and inner side margin 20 form the right angle legs of the pocket and the outer side margin 22 forms the hypotenuse thereof.

The angle at which inner side margin 22 lies with relation to outer side margin 20 is important because it determines the position which the holster and gun will assume when being worn. As noted above, the desired use position is that in which inner side margin 20 is substantially vertical, and outer side margin 22 assumes an angle such that it is substantially parallel to, and lies adjacent or within, the groin of the wearer. The groin by definition is the fold or depression between the lower part of the abdomen and the thigh.

Means are provided for mounting the holster on a garment, for example on belt 10.

In the illustrated form of the invention such means comprises a pair of integral belt straps 26, 28 on one of the holster panels (front panel 12 in the drawings). These cooperate with associated slits 30, 32, respectively in the panel in forming infinitely adjustable loops which encircle the belt and provide the desired holster support.

Figure 3:
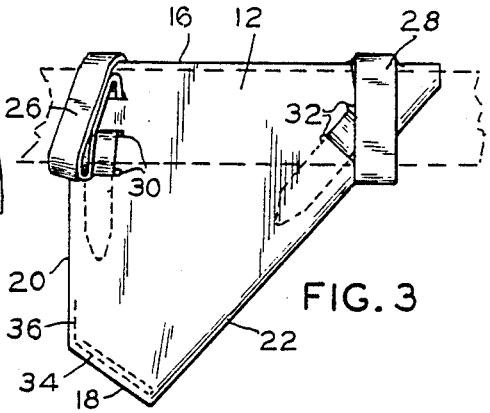
FIG. 3 is a view in front elevation of the holster.
Figure 5:
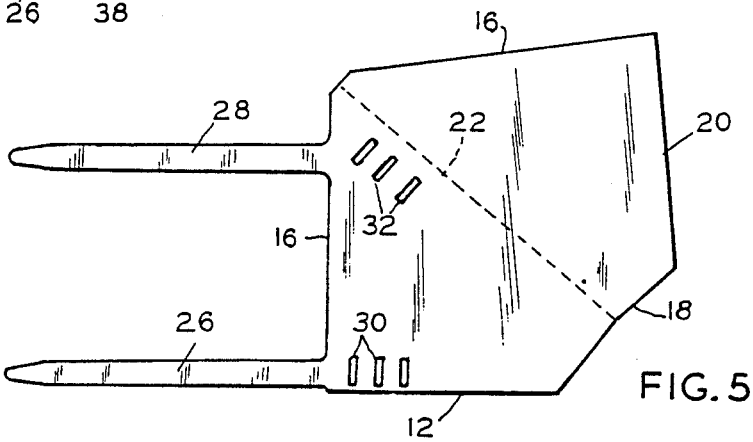
FIG. 5 is a plan view of a cut and contoured piece indicating the manner in which the holster may be simply made from a sheet of leather or other suitable holster material.

The holster thus may be fabricated in the manner illustrated in FIG. 5. A blank of the indicated contour is cut from a piece of high grade leather or other suitable holster material. The material then is folded centrally along the dashed line of FIG. 5 to form outer side margin or spine 22. The bottom or foot 18 is formed by appropriately placed stitching 34. The partially closed side margin 20 is formed by side margin stitching 36, FIGS. 3 and 4, of the predetermined and desired length.

In use, the holster is mounted to belt 10 on either the right or left side (on the left side in the drawings) with partially open side margin 20 disposed substantially vertically and top edge 16 substantially horizontally, projecting only slightly, if at all, above the top edge of belt 10.

This will place the outer side margin 22 of the holster at an angle such that the holster outer side margin, and hence the gun itself, will lie in the groin area of the wearer. Such an oblique positioning of the gun will cause the gun butt 24 to extend angularly upwardly from the mouth of the holster in the manner shown at FIG. 1. The gun butt only thus is exposed. Most of the assembly is concealed beneath the pants or skirt, since it is positioned between the garment waistband and the wearer's waist. The waistband of the pants or skirt may or may not support a belt, as by the belt loops illustrated, in conventional manner. The exposed gun butt may be concealed by a superimposed shirt 38, FIG. 1.

The butt of the gun accordingly is located within a few inches of the gun hand when the latter is in a normal position at the front or side. It is a feature of the invention that when thus disposed the gun may be quickly withdrawn in a concealed manner with equal facility using either the right or left hand.

To withdraw the gun using the off hand (the right hand in FIG. 1), the hand is slipped beneath shirt 38 to a position in which it overlies the outside edge (back) of gun butt 24, with the thumb inserted between the gun butt and the abdomen and the palm of the hand bearing against the upper portion of the gun butt. The hand then is pressed downwardly and simultaneously moved laterally (horizontally) to the right in the direction of the belt buckle.

When this is done, the gun muzzle, which bears against the bearing area provided by closed bottom or foot 18, will pivot about itself, causing the gun to rise into the hand before the hand reaches the buckle. This all is accomplished without engaging the trigger, providing an important safety factor. The trigger cannot be reached until the gun barrel is clear of the holster. This occurs only during the final fraction of the draw when the gun is withdrawn from the holster.

In one procedure for withdrawing the gun using the near hand (the left hand in FIG. 1), the hand is inserted flatwise beneath the shirt slightly above the gun butt. With a downward motion the heel of the hand engages the uppermost portion of the gun butt. Continuing the downward motion along with a very slight counterclockwise motion, as viewed axially endwise, rolls the gun from the holster and places it instantly in an exposed, operative position. This is a very safe method since the finger cannot come in contact with the trigger until the gun is completely free of the holster.

Both right hand and left hand withdrawal may be executed in an instant. The person who is the object of the procedure first becomes aware of it when he finds himself looking directly into the barrel of the gun.

As an incidental but important benefit, it is noted that by the simple maneuver of bending slightly forwardly preliminary to acting, the gun user can assure himself that the gun is located properly in the groin area as desired for quick withdrawal.

This simplified procedure is to be contrasted with the manner of use of conventional handbelt gun holsters concealed behind a coat wherein it is necessary first to draw the coat aside, reach to the side or behind, physically grasp the gun butt, withdraw the gun, and move it to its shooting position. This leaves the operator in an exposed and vulnerable position.

Granted that an experienced person can accomplish these maneuvers rapidly, substantially less time is required to withdraw the gun from the holster of my invention and place it in shooting position, and the maneuver can be accomplished almost totally while the gun and hand are concealed beneath the shirt.

Having thus described in detail a preferred embodiment of the invention, it will be apparent to those skilled in the art that various physical changes may be made without altering the inventive concepts and principles embodied. The present embodiment is therefore to be considered as illustrative and not restrictive, the scope of the invention being indicated by the appended claims.

I claim:

1. A quick-draw handgun holster adapted to hold a handgun having a top surface extending substantially normal to a butt and to be worn concealed between the waistband of a garment and a wearer's waist in the abdominal area and offset from the center thereof and comprising, in the worn position, front and back panels joined to form a pouch contoured and dimensioned to provide a top, a bottom, an inner side margin proximate the navel of the wearer and an outer side margin proximate the wearer's hips;

the top being open and wide-mouthed to receive a gun;

the bottom being substantially closed to provide an inner bearing area against which the muzzle of a gun bears and pivots during its sheating in, and withdrawal from, the holster;

the inner side margin being open along its upper length to permit pivoting of a gun during its sheathing and withdrawal;

the outer side margin being substantially closed and configured to provide an inner bearing area against which the top surface of a gun rests when it is in its sheathed position within the holster;

means for attaching said holster to the waistband of a garment such that the inner and outer side margins would be disposed at an angle relative to each other such that when the holster is mounted between the waistband and a wearer's waist, the inner side margin would be positioned substantially vertically, and its outer side margin would lie substantially parallel to and received in the groin area of the wearer; and the length of the holster being such that when a gun is sheathed obliquely within the holster with its muzzle bearing against the holster bottom and its top surface bearing against the holster outer side margin, its butt will project angularly upwardly above the holster top to a predetermined position in which it is readily available for engagement by the hand of the wearer.

2. The holster of claim 1 adapted to be worn in combination with a belt which surrounds the garment waistband, whereby said attachment means releasably attaches the holster to the belt in a predetermined location.

3. The holster of claim 2 wherein the attachment means comprises loops formed integrally with the holster and dimensioned and contoured for encircling the belt.

4. The holster of claim 3 wherein there are two loops spaced apart along the upper portion of the front panel.

5. The holster of claim 1 comprising a single piece of holster material folded centrally to form the front and back panels and stitched along its bottom end to provide the substantially closed holster bottom.

6. The holster of claim 1 wherein the inner and outer margins are disposed at an angle of from about 30 to about 60 degrees relative to each other.

7. The holster of claim 1 wherein the inner and outer margins are disposed at an angle of from about 35 to about 55 degrees relative to each other.

8. The method of quick-drawing a handgun from a holster which comprises:

providing a holster having an open top, a substantially closed bottom and a substantially open inner side, wearing the holster in a concealed position between the waistband of a garment and a wearer's waist in the groin area such that the gun butt protrudes above the waistband of the garment, placing the gun in the holster in an oblique position with the gun muzzle bearing against the holster bottom and the gun butt protruding angularly upwardly from the holster such that a substantial portion of said gun is located between the garment waistband and the wearer's waist, withdrawing the gun from the holster by drawing the hand substantially horizontally across the abdominal area, thereby engaging the protruding gun butt end and pivoting the gun about its muzzle to an elevated position in which the gun rises out of the holster, an continuing the substantially horizontal lateral motion of the hand to swing the gun out of the open side of the holster and into its operative position within the hand.

* * * * *